US007664274B1

(12) United States Patent
Graumann

(10) Patent No.: US 7,664,274 B1
(45) Date of Patent: Feb. 16, 2010

(54) ENHANCED ACOUSTIC TRANSMISSION SYSTEM AND METHOD

(75) Inventor: David L. Graumann, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 2398 days.

(21) Appl. No.: 09/603,939

(22) Filed: Jun. 27, 2000

(51) Int. Cl.
*H04R 3/02* (2006.01)
*H04H 20/47* (2008.01)

(52) U.S. Cl. ..... 381/73.1; 380/238; 381/2

(58) Field of Classification Search ..... 381/1–4, 381/73.1; 704/200.1; 380/38–40, 53, 237, 380/238

See application file for complete search history.

(56) References Cited

U.S. PATENT DOCUMENTS 4,035,838 A * 7/1977 Bassani et al. ..... 725/110
4,876,617 A * 10/1989 Best et al. ..... 360/60
6,584,138 B1 * 6/2003 Neubauer et al. ..... 375/130

OTHER PUBLICATIONS

1996 IEEE International Conference on Multimedia Computing and Systems, Jun. 17-23, Hiroshima, Japan; Laurence Boney et al.; "Digital Watermarks for Audio Signals", pp. 473-480.*

* cited by examiner

*Primary Examiner*—Xu Mei
(74) *Attorney, Agent, or Firm*—Grossman, Tucker, Perreault & Pfleger, PLLC

(57) ABSTRACT

A system to generate an enhanced acoustic transmission signal includes a carrier signal generator to generate a carrier signal. A data signal generator is provided to receive data and to generate a data signal representing the data. A signal modulator is also provided to modulate the carrier signal with the data signal to form a modulated carrier signal at a carrier frequency. The system includes a masking signal generator to generate a masking signal to mask the modulated carrier signal from being audible by a human ear. An audio input device is provided to receive audio and to generate an audio signal based on the audio, wherein a frequency band surrounding the carrier frequency is removed from the audio signal. A signal adder is also provided to combine the modulated carrier signal, the masking signal, and the audio signal to form the enhanced acoustic transmission signal.

27 Claims, 5 Drawing Sheets

ENHANCED ACOUSTIC TRANSMISSION SYSTEM AND METHOD

BACKGROUND OF THE INVENTION

1. Field of the Invention

The present invention relates to a system and method for generating an enhanced acoustic transmission signal for a psychoacoustically-motivated auditory band communication channel carrying data and audio signals.

2. Discussion of the Related Art

When exploring the psychology of hearing as a means to improved human computer interfaces, it becomes apparent that there are vast differences between the human auditory system and acoustical transducers used by computers. Though both convert sound pressure waves into energy differentials, the resultant signals do not have similar spectral content. A transducer, (e.g., a microphone) often has a near-flat frequency response that is not tuned to human speech. It converts all frequencies into appropriate voltage levels that are limited only by its sensitivity and dynamic range. If digitally sampled for computer enhancement, the frequency response is additionally determined by the Nyquist frequency. In the digital domain, there exists many methods for extracting all of the frequencies present in the signal whether or not they are audible by human ears. A very different signal is made available through the auditory system for human cognition. For the human percept, there are many preprocessing mechanisms that limit access to the frequencies in the environment. These preprocessing mechanisms include the natural resonance of the ear canal, the time-varying non-linear transfer function of the middle ear, and the complex conversion of mechanical pressures to electrochemical firings taking place in the cochlea. The physics of this complex conversion process is quite remarkable—sound energy is converted into mechanical motion, which is converted back to sound energy, then converted back into mechanical motion, which is detected and converted into electrochemical nerve signals. These processes selectively enhance perception of human speech and important localization phenomenon, as opposed to simply converting sound pressure into neuron firings. The human auditory system distinguishes sounds on the basis of duration, direction, pitch, loudness, and timbre.

Psychoacoustic masking has been used in digital speech processing over the last 10 years. There also exists masking techniques used in the encoding of audio signals to best avoid perceptual encoding noises. Additionally, there are masking techniques used in some acoustic noise reduction schemes for reducing the aggressiveness of the reduction. However, there are currently no viable psychoacoustic masking applications for use in in-band communication channels for creating enhanced acoustic transmission signals that are compatible with legacy analog communication systems, such as conventional telephones.

DETAILED DESCRIPTION

According to an embodiment of the present invention, an enhanced acoustic transmission signal seeks to exploit a discrepancy between "computer listening" and "human listening" by leveraging auditory simultaneous masking. Simultaneous masking refers to the phenomenon in which one signal being presented to the ear limits the ability for some set of other signals to be audible. The masked signals become imperceivable, or nearly so. An embodiment of the present invention utilizes a masking signal, such as a narrowband stationary noise signal, to mask a carrier signal, which may be an adjacent pure tone signal. The masking takes place in the cochlea of the human ear. By stimulating the basilar membrane with random noise or a bandwidth less than one critical band of the carrier signal, one's ability to distinguish the carrier signal, and particularly pure tones, within the critical band becomes greatly diminished.

In the human ear, each band of frequencies is centered around a frequency where the response of a given nerve is most sensitive (more specifically, the frequency that takes the smallest signal to trigger the nerve to fire). The width of the band around this central frequency is called the critical bandwidth (or critical band). Therefore, two sounds with close frequencies, within the critical bandwidth will both cause the same nerve cells to fire.

The present invention includes a system for generating a masked encoded signal within an enhanced acoustic transmission signal. The enhanced acoustic transmission signal may be generated by a communications device, such as a telephone handset having an encoder or a computer having telephony support (such as Internet Protocol (IP) telephony), adapted to generate and encode enhanced acoustic transmission signals for transmission to another communications device. The other communication device may be a decoding handset that can decode and utilize the data being transmitted, or it may be a legacy analog handset that can output the audio portion of the enhanced acoustic transmission signal.

Figure 1:
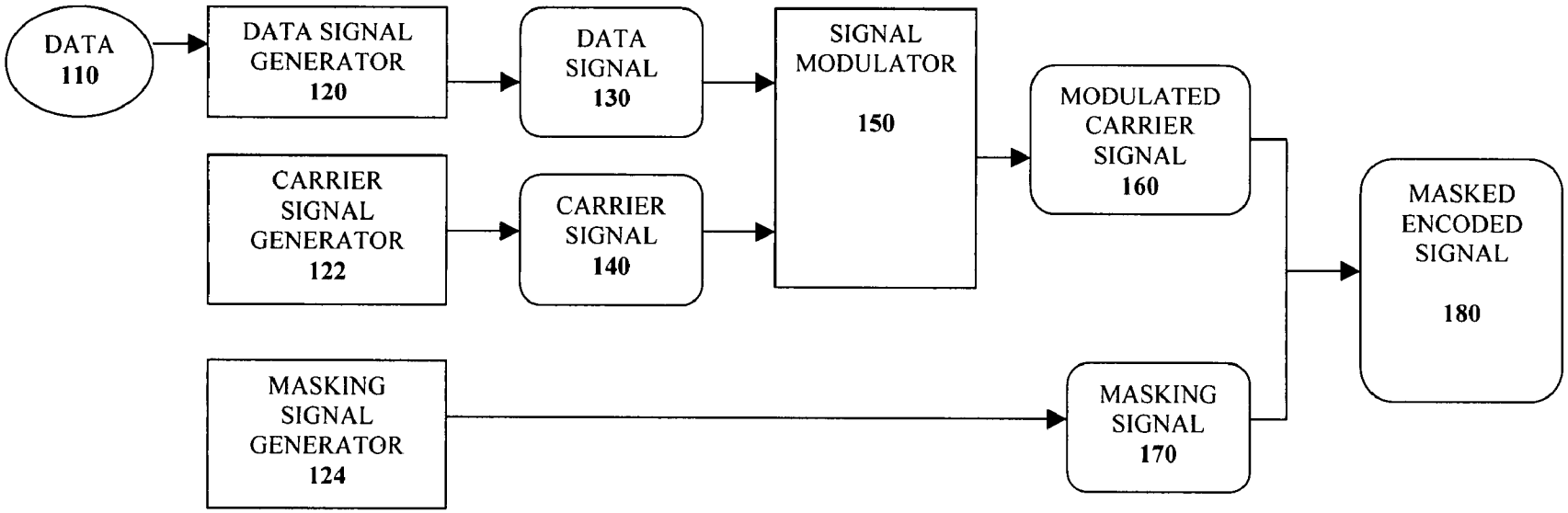
FIG. 1 illustrates a system for generating a masked encoded signal according to an embodiment of the present invention.
Figure 4:
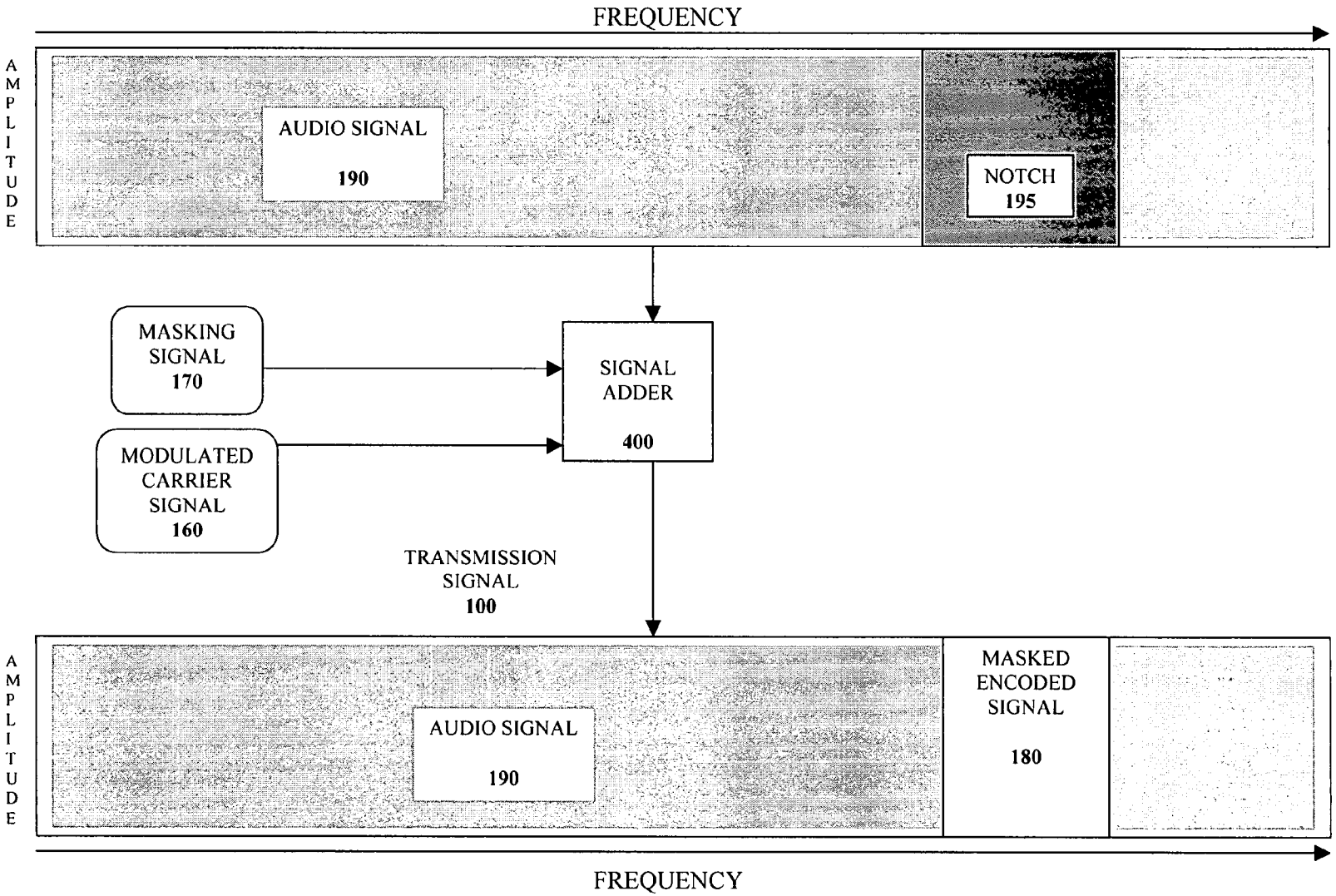
FIG. 4 illustrates a system for generating an enhanced acoustic transmission signal according to an embodiment of the present invention.

The enhanced acoustic transmission signal (the composite signal 100 as illustrated in FIG. 4) includes the masked encoded signal 180 and the audio signal 190. Referring to FIG. 1, the masked encoded signal 180 includes a modulated carrier signal 160 and a masking signal 170. Data 110 to be transmitted with the audio signal 190 is transmitted to a data signal 120, generator 120, which converts the data 110 into a data signal 130. The data 110 may be any data, and may be used to enhance the telephony experience, such as data for formant expansion into wide-band audio for enriching speech quality, personal/business information (such as mailing addresses, telephone and facsimile numbers, e-mail and Internet addresses, business hours, etc.), simple text messaging for instant information synchronization, enhanced conversation logging by sharing tracking information, or even replacement of dual-tone multi-frequency (DTMF) in-band signaling.

The data signal generator 120 may be a computer, or other device (such as a document scanner, or a business card scanner), used to input or receive data. The data signal generator 120 may have a data storage device to store the data, such as a hard disk drive, optical drive (CD-ROM, DVD, etc.), floppy disk drive to receive floppy disks, or even a keyboard for the user to input data to be transmitted. Other devices may be used to input or receive data and convert the data 110 into a data signal 130. The data signal 130 may be of any format that is capable of representing the data 110. For example, the data signal 130 may be a series of 16 kHz digital signal pulses representing the data 110 in a sequence having a coded format, such as Morse Code (in the form of dots, dashes, and pauses). If the data 110 in the data signal 130 is represented by the length and order of regularly recurring pulses, as in the case of Morse Code, then pulse-duration modulation (PDM) may be performed on the carrier signal 140, as further discussed below. However, any suitable technique for representing the data 110 in the data signal 130 may be utilized. Additionally, any suitable modulation technique may be performed on the carrier signal 140 using the data signal 130.

The selection of the carrier signal 140 is one of the parameters used to generate the masked encoded signal 180. A carrier signal generator 122 generates a carrier signal 140 for carrying the data 110 within the data signal 130. The carrier signal 140 is preferably a signal that is capable of being masked by a masking signal 170 generated by a masking signal generator 124. The carrier signal 140 may be, for example, a pure tone sine wave.

The frequency of the carrier signal 140 to be used depends on the application of the enhanced acoustic transmission signal 100. For example, because the frequency of current "plain old telephone system" (POTS) telephony ranges only from 300 Hz to 3.8 kHz, the carrier frequency 140 must be at a frequency within the 300 Hz to 3.8 kHz range if the transmission signal 100 is to be used in conventional POTS systems. However, if a wide-band audio channel is utilized (such as one having 16 kHz samples per second), a higher carrier frequency may be used, such as a 7 kHz carrier frequency. If a wide-band audio channel is available, the 7 kHz carrier frequency is a good choice because at 7 kHz, the carrier frequency resides in a range in which there is far less speech energy, and human equal loudness contours show a marked decrease in absolute signal sensitivity at frequencies of about 5 kHz and greater.

The data signal 130 and the carrier signal 140 are transmitted to a signal modulator 150, which combines the two signals to produce a modulated carrier signal 160. The carrier signal 140 is modulated with the data signal 130 to produce the modulated carrier signal 160. As discussed above, the carrier signal 140 may be, for example, a pure tone sine wave. If, for example, pulse-duration modulation (PDM) is performed on the pure tone sine wave carrier signal 140 using the data signal 130 (wherein the data 110 is represented by the length and order of regularly recurring pulses in a sequence of the data signal 130), the resulting modulated carrier signal 160 would be a pulsed pure tone sine wave. The modulated carrier signal 160 is the original carrier signal 140 modulated with the data signal 130 so as to "carry" the data signal 130. Of course, other modulation techniques may be implemented as well, such as amplitude modulation (AM), frequency modulation (FM), pulse-code modulation (PCM), etc.

The masking signal 170 is generated by a masking signal generator 124. The masking signal generator 124 may be any device capable of generating a masking signal 170 (e.g., noise) having a bandwidth less than one critical band of the modulated carrier signal 160. The masking signal 170 is used to mask the modulated carrier signal 160 from being audible by a human ear The masking signal 170 is preferably a narrowband random noise sequence. However, other masking signals may be utilized as well. For example, it is known that at 7 kHz, the critical band is approximately 800 Hz. Therefore, a masking signal 170 between 6.6 kHz and 7.4 kHz would fall within the critical band of the modulated carrier signal 160. A masking signal 170 at a frequency of 6.6 kHz may be chosen in this example, because it falls within the critical band of the modulated carrier signal 160 frequency and allows for good separation of the masking signal 170 and the modulated carrier signal 160 by using a narrowband filter. At 6.6 kHz, the masking signal 170 allows for a modest finite impulse response (FIR) filter to isolate the modulated carrier signal 160 without significant out-of-band noise leakage, while still keeping the masking signal 170 within the 800 Hz critical band around the 7 kHz carrier.

The "acceptable" signal strength of the masking signal 170 is a factor in determining the signal strength of the modulated carrier signal 160. In other words, the determination of the masking signal 170 signal strength is, "How loud can the masking noise be without being objectionable to the listener?" The perceptual characteristics of loudness adaptation by the human ear is a factor to consider. There is evidence that low-level steady sounds are perceived with less loudness after continual exposure. More specifically, tones at levels below 30 decibels (dBs) sound pressure level (SPL) audibly vanish for some people after exposure over one minute. (Brian Moore, "An Introduction to the Psychology of Hearing", Academic Press, IV Ed., 1997, pp. 77-78.) It was found that a random noise masking signal 170 having a bandwidth of 90 Hz and a level of 30 dB SPL is acceptable for use as a masking signal 170 having a center frequency of 6.6 kHz as discussed above. However, broader bandwidths and lower level masking signals 170 may be utilized as well, especially when considering the use of narrowband communication channels where the threshold of hearing drops considerably. Because loudness adaptation varies from person to person, perfect masking may not occur for each individual.

For the most part, the masking signal 170 to be utilized should substantially mask the (modulated) carrier signal 160 from being audible by the human ear. The loudness of the masking signal 170 is preferably of low enough loudness to be acceptable to a user while masking as much of the modulated carrier signal 160 as possible. The final values determined for the masking signal 170 and the modulated carrier signal 160 may simply be a compromise to obtain the best results in all given situations. Once the modulated carrier signal 160 and the masking signal 170 have been generated, they are combined to form the masked encoded signal 180.

Figure 2:
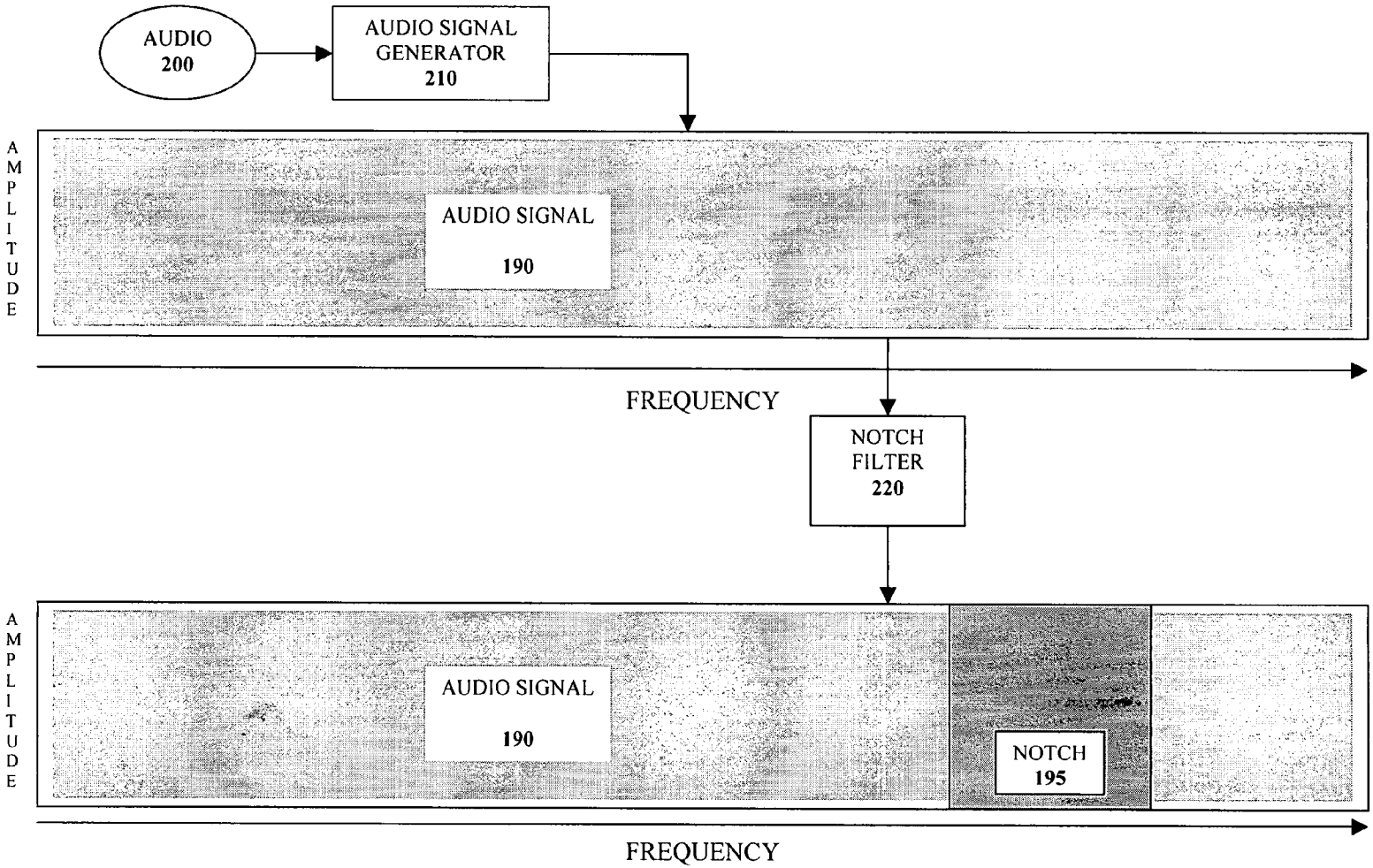
FIG. 2 illustrates a system for generating an audio according to an embodiment of the present invention.

FIG. 2 illustrates a system for generating an audio signal according to an embodiment of the present invention. An audio signal generator 210, receives audio 200, such as voice, music, etc. (from a microphone, telephone handset, a storage medium such as a cassette tape player, CD/CD-ROM, hard disk drive, DVD, tapeless player, etc.), and generates an audio signal 190 for transmission to a receiving device. The audio signal 190 is then passed through a notch filter 220. The audio signal 190 is preferably "notched" so that a relatively narrow band of frequencies surrounding the frequency of the modulated carrier signal 160 is removed from the audio signal 190. The notch 195 (or "dead air" band) helps avoid adverse affects the audio signal 190 may have upon the modulated carrier signal 160. Notching the audio signal helps to better retain the integrity of the data within the modulated carrier signal. Once the enhanced acoustic transmission signal is generated, it may be transmitted to a receiver or decoding device, such as a computer system having telephony support, a decoding handset capable of reproducing audio as well as utilizing the data transmitted along with the audio signal, or even to a legacy handset (conventional telephone) without support for the data extraction features of a decoding handset or computer system.

Figure 3:
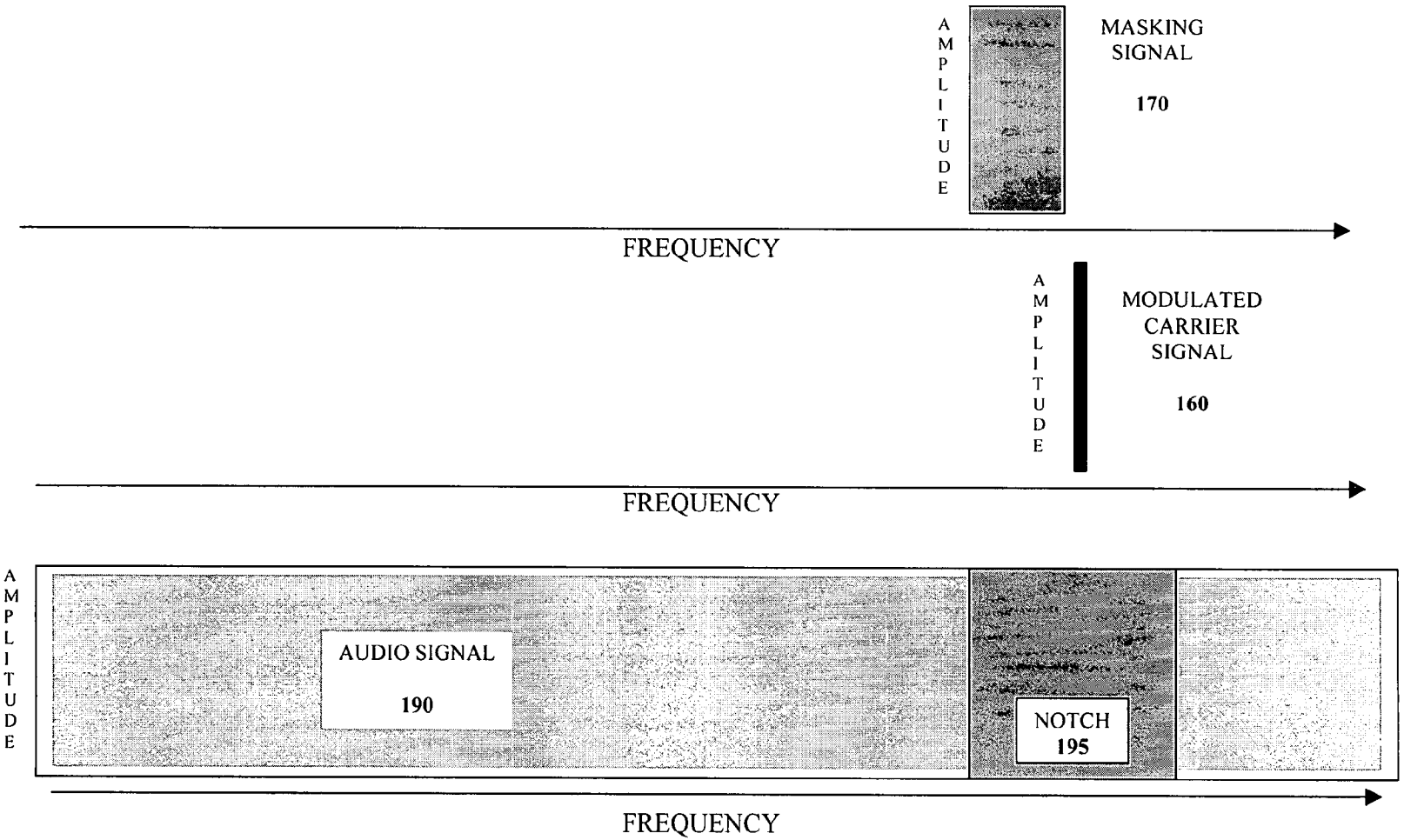
FIG. 3 illustrates the components of an enhanced telephone transmission signal in the frequency domain according to an embodiment of the present invention.

FIG. 3 illustrates the components of an enhanced telephone transmission signal in the frequency domain according to an embodiment of the present invention. As shown, the audio signal 190 has a notch 195 wherein a narrow band of frequencies surrounding the modulated carrier signal 160 is removed. The audio signal 190 is combined with the modulated carrier signal 160 and the masking signal 170 to form the enhanced acoustic transmission signal 100 (see FIG. 4). In the example shown in FIG. 3, the modulated carrier signal 160 frequency is at the upper-end of the frequency spectrum. The masking signal 170 frequency is close in frequency to the modulated carrier signal 160. The masking signal 170 having a bandwidth less than one critical band of the modulated carrier signal 160. By having a bandwidth within one critical band of the modulated carrier signal 160, the masking signal 170 preferably masks the modulated carrier signal 160 from being audible by a human ear.

FIG. 4 illustrates a system for generating an enhanced acoustic transmission signal according to an embodiment of the present invention. The masked encoded signal 180 (as illustrated in FIG. 1) may be combined with the notched audio signal 190 by a signal adder to form the enhanced acoustic transmission signal 100. The modulated carrier signal 160 and the masking signal 170 need not be combined prior to being combined with the audio signal 190. Rather, the modulated carrier signal 160, the masking signal 170, and the audio signal 190 may be combined simultaneously by a signal adder 400, or in any other order, to form the enhanced acoustic transmission signal 100.

The motivation for placing a masked encoded signal 180 in the notch 195 of the audio signal 190 is not readily apparent. The main advantage of sending this signal is to enhance the computer telephony experience, while still allowing full unaltered communication with legacy handsets. A decoding handset can detect and utilize the enhanced acoustic transmission signals even over public switched telephone networks (PSTNs) to enhance the audio in a number of ways. On the other hand, if an encoding handset connects to a legacy telephone, or a non-proprietary telephony system not capable of handling the encoding scheme, the encoded signal will not be noticeable by the listener because it is masked, yet it will retain the former audio capabilities of all other non-decoding telephones.

If the receiver is a legacy or non-proprietary handset, such as a conventional analog telephone, the audio portion of the enhanced acoustic transmission signal 100 may be perceived by the listener, while the data within the modulated carrier signal 160 is masked by the masking signal 170 noise so as to be imperceptible by the listener on the legacy or non-proprietary handset. As noted above, perfect masking may not occur (e.g., the listener may hear an occasional "beeping" sound from the modulated carrier signal 170). The masking signal 170 may be initially perceptible to the listener as well. However, due to human loudness adaptation, most listeners will cease to notice the noise from the masking signal after continued exposure.

Figure 5:
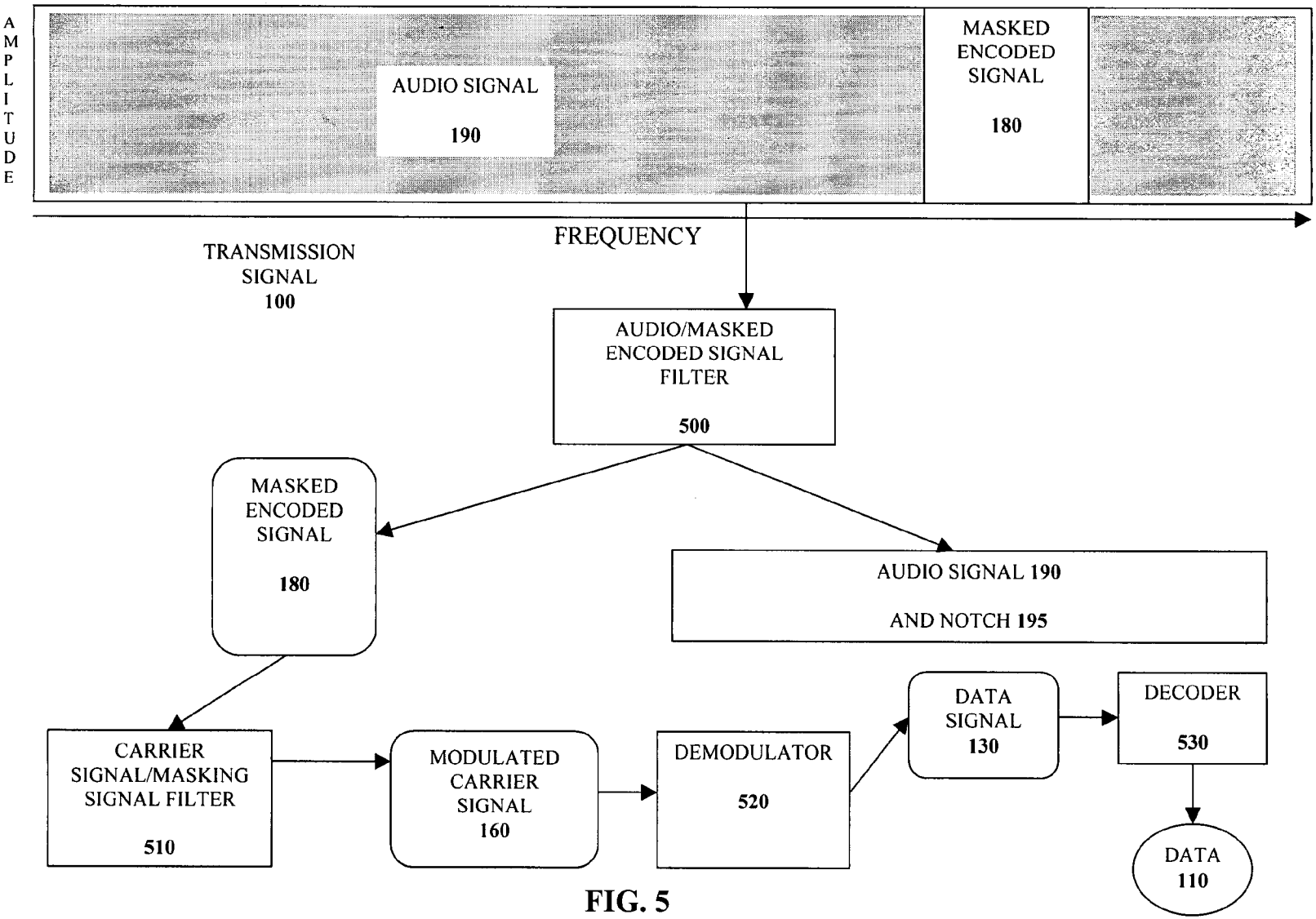
FIG. 5 illustrates a decoding device for decoding an enhanced acoustic transmission signal according to an embodiment of the present invention.

FIG. 5 illustrates a decoding device for decoding an enhanced acoustic transmission signal according to an embodiment of the present invention. If the receiver is a decoding device, the enhanced acoustic transmission signal 100 is filtered by an audio/masked encoded signal filter 500 of the decoding device to isolate the masked encoded signal 180 from the audio signal 190. The audio signal 190 may be sent to a reproduction device, such as a speaker, or it may be stored on a storage device, such as a cassette tape recorder, hard disk drive, optical drive (CD/CD-ROM, DVD), etc. The modulated carrier signal 160 may be separated from the masked encoded signal 180 by using a filter 510, such as a narrowband finite impulse response (FIR) filter, and then passed to a demodulator 520 to demodulate the modulated carrier signal 160 to extract the data signal 130. Additionally, the masked encoded signal 180 may be transmitted straight to the demodulator 520, which is capable of extracting the modulated carrier signal 160 from the masked encoded signal 180 and demodulating the modulated carrier signal 160 to extract the data signal 130. Once the data signal 130 is isolated, the data signal 130 is passed to a decoder 530 to decode the data signal 130 to extract the data 110. For example, if a pulse-duration modulation (PDM) scheme was utilized for modulating the carrier signal with the data signal, the detection of the pulses representing the data 110 (e.g., the dot, dash, and pause sequences in Morse code) may be decoded by comparing the energy ratios of the signals in the carrier signal 160 with the energy in the masking signal 170. A threshold ratio level may be set (e.g., at greater than 0.5) to determine when a pulse is "on", thereby determining the pulse sequence. Based on the encoding algorithm utilized, the entire pulse sequence may be converted/translated into data useable by the decoding device.

Another embodiment of the present invention includes the use of the enhanced acoustic transmission signal 100 to be broadcast over open space, as in a room or outdoor area using a speaker, such as a public announcement (PA) system. Therefore, in addition to the audio transmitted over the air to listeners in the audible area, a masked encoded signal 180 is transmitted therewith, and, any decoding receiver device within the audible area may be adapted to receive the masked encoded signal 180 transmitted with the audio and extract any data transmitted therewith. For example, a receiver device having a microphone, remotely located from the speaker, may pick up the audio as well as the masked encoded signal 180 broadcast from the speaker. And, the receiver device may be adapted to extract any data 110 within the masked encoded signal 180.

Furthermore, the receiver device may be embodied within a portable device, such as a cellular telephone, personal digital assistant (PDA, like a Palm computer), a laptop computer, or any other similar device. For example, if a user is at an airport terminal with a portable receiver device adapted to decode a masked encoded signal 180, and flight information is announced over the PA system, the portable receiver device, when properly configured, may receive the masked encoded signal 180 containing the flight information transmitted along with the audio announcement so that the user may review the data displayed on the portable receiver device, especially if the user did not hear all of the information announced over the PA speakers.

Additionally, the masked encoded signal 180 may contain data to be used as a "watermark" in order to authenticate and/or identify audio broadcasts. For example, serial number/identifying information or other information, which may be encrypted, may be transmitted in the masked encoded signal 180 along with the audio broadcast sent over the air through a speaker. The audio broadcast may then be identified, using a receiving device to extract the watermark information from the masked encoded signal 180 transmitted with the audio broadcast. As with any of the "open air" masked encoded signal 180 audio broadcasts using a speaker, the receiving device is adapted to overcome additional error-creating variables present in open air situations, such as outside noise, and requires a more robust system than that used in, for example, a telephony application.

While the description above refers to particular embodiments of the present invention, it will be understood that many modifications may be made without departing from the spirit thereof. The accompanying claims are intended to cover such modifications as would fall within the true scope and spirit of the present invention. The presently disclosed embodiments are therefore to be considered in all respects as illustrative and not restrictive, the scope of the invention being indicated by the appended claims, rather than the foregoing description, and all changes that come within the meaning and range of equivalency of the claims are therefore intended to be embraced therein.

What is claimed is:

1. A method of generating an enhanced acoustic transmission signal, the method comprising:

generating a carrier signal;

receiving data and generating a data signal representing the data;

modulating the carrier signal with the data signal to form a modulated carrier signal at a carrier frequency;

generating a masking signal to mask the modulated carrier signal from being audible by a human ear;

receiving audio and generating an audio signal based on the audio;

removing a frequency band surrounding the carrier frequency from the audio signal; and combining the modulated carrier signal, the masking signal, and the audio signal to form the enhanced acoustic transmission signal.

2. The method according to claim 1, wherein the carrier signal is a sine wave.

3. The method according to claim 2, wherein the modulated carrier signal is a pulsed sine wave.

4. The method according to claim 1, wherein the masking signal is narrowband random noise.

5. The system according to claim 1, wherein the modulated carrier signal is at a level that is detectable by a decoding system while still being masked by the masking signal.

6. The system according to claim 1, wherein the masking signal has a bandwidth less than one critical band of the modulated carrier signal.

7. A method of decoding an enhanced acoustic transmission signal including a modulated carrier signal formed by modulating a carrier signal at a carrier frequency with a data signal representing data, a masking signal adapted to mask the modulated carrier signal from being audible by a human ear, and an audio signal modified so that a frequency band surrounding the carrier frequency is removed from the audio signal, the method comprising:

receiving the enhanced acoustic transmission signal;

filtering the enhanced acoustic transmission signal to isolate the modulated carrier signal from the masking signal and the audio signal of the enhanced acoustic transmission signal;

demodulating the modulated carrier signal to extract the data signal from the modulated carrier signal; and decoding the data signal to extract the data.

8. The method according to claim 7, wherein the modulated carrier signal is isolated from the masking signal by using a finite impulse response (FIR) filter.

9. A system to generate an enhanced acoustic transmission signal, the system comprising:

a carrier signal generator to generate a carrier signal;

a data signal generator to receive data and to generate a data signal representing the data;

a signal modulator to modulate the carrier signal with the data signal to form a modulated carrier signal at a carrier frequency;

a masking signal generator to generate a masking signal to mask the modulated carrier signal from being audible by a human ear;

an audio input device to receive audio and to generate an audio signal based on the audio;

a notch filter to remove a frequency band surrounding the carrier frequency from the audio signal; and a signal adder to combine the modulated carrier signal, the masking signal, and the audio signal to form the enhanced acoustic transmission signal.

10. The system according to claim 9, wherein the carrier signal generator is a sine wave generator that generates a sine wave.

11. The system according to claim 10, wherein the modulated carrier signal is a pulsed sine wave.

12. The system according to claim 9, wherein the masking signal generator is a narrowband random noise generator to generate narrowband random noise.

13. The system according to claim 9, wherein the modulated carrier signal is at a level that is detectable by a decoding system while still being masked by the masking signal.

14. The system according to claim 9, wherein the system is a telephone system having a microphone connected to the audio input device to receive audio, and a data input device connected to the data signal generator to enter data into the system.

15. The system according to claim 9, wherein the masking signal has a bandwidth less than one critical band of the modulated carrier signal.

16. The system according to claim 9, wherein the modulated carrier signal and the masking signal are first combined to form a masked encoded signal, then the audio signal is combined with the masked encoded signal to form the enhanced acoustic transmission signal.

17. The system according to claim 9, wherein the modulated carrier signal, the masking signal, and the audio signal are combined simultaneously to form the enhanced acoustic transmission signal.

18. A system to decode an enhanced acoustic transmission signal including a modulated carrier signal formed by modulating a carrier signal at a carrier frequency with a data signal representing data, a masking signal adapted to mask the modulated carrier signal from being audible by a human ear, and an audio signal modified so that a frequency band surrounding the carrier frequency is removed from the audio signal, the system comprising:

a receiver to receive the enhanced acoustic transmission signal;

a filter to filter the enhanced acoustic transmission signal to isolate the modulated carrier signal from the masking signal and the audio signal of the enhanced acoustic transmission signal;

a demodulator to demodulate the modulated carrier signal to extract the data signal from the modulated carrier signal; and a decoder to decode the data signal to extract the data.

19. The system according to claim 18, wherein the modulated carrier signal is isolated from the masking signal by using a finite impulse response (FIR) filter.

20. The system according to claim 18, wherein the system is a telephone system having a speaker to produce audio from the audio signal, and a display to show the data extracted from the modulated carrier signal.

21. A method to generate an output audio signal, comprising:

removing a range of frequencies in an audio signal to produce a notched audio signal;

generating a masking signal that falls entirely within one portion of the range of frequencies;

generating a data signal that falls in entirely within the range of frequencies and apart from the one portion; and combining the notched audio signal, the masking signal, and the data signal to form the output audio signal.

22. The method of claim 21, further comprising:

transmitting the output audio signal.

23. The method of claim 21, wherein the masking signal falls within a critical band of the data signal.

24. The method of claim 21, wherein the generating a data signal includes:

modulating data with a carrier signal in the range of frequencies and apart from the one portion.

25. A method of processing a combined audio signal, comprising:

receiving the combined audio signal including a masking signal residing in a frequency range, a data signal residing in the frequency range, and audio information residing outside the frequency range;

separating the masking signal and the data signal in the frequency range from the audio information outside the frequency range; and filtering the data signal in the frequency range from the masking signal.

26. The method of claim 25, wherein the masking signal resides in a first portion of the frequency range that is distinct from a second portion of the frequency range in which the data signal resides.

27. The method of claim 25, further comprising:

decoding or demodulating the data signal after the filtering to extract data from the data signal.

* * * * *

UNITED STATES PATENT AND TRADEMARK OFFICE

CERTIFICATE OF CORRECTION

PATENT NO. : 7,664,274 B1
APPLICATION NO. : 09/603939
DATED : February 16, 2010
INVENTOR(S) : David L. Graumann It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 3197 days.

Signed and Sealed this

Twenty-eighth Day of December, 2010

David J. Kappos

David J. Kappos
*Director of the United States Patent and Trademark Office*